US006158155A

United States Patent [19]

Boney

[11] Patent Number: 6,158,155

[45] Date of Patent: Dec. 12, 2000

[54] LID FOR A BEVERAGE CONTAINER

[76] Inventor: David Hunter Boney, 918 SW. Dr., Davidson, N.C. 28036

[21] Appl. No.: 09/248,543

[22] Filed: Feb. 11, 1999

Related U.S. Application Data

[63] Continuation-in-part of application No. 09/119,573, Jul. 21, 1998.

[51] Int. Cl.[7] ..... G09F 11/04

[52] U.S. Cl. ..... 40/307; 40/310; 40/311; 215/230

[58] Field of Search ..... 40/307, 310, 311, 40/113; 215/230

[56] References Cited

U.S. PATENT DOCUMENTS

| | | | |
|---|---|---|---|
| 783,401 | 2/1905 | Curran | 215/230 |
| 1,677,155 | 7/1928 | Swift | 215/230 |
| 4,662,520 | 5/1987 | Griffin | 40/307 |

*Primary Examiner*—Cassandra H. Davis

[57] ABSTRACT

A lid for covering a beverage container. The lid includes a platform configured for engaging the container, and the platform includes retaining structure and a top surface with indicia associated therewith. An index member is retained generally on the top surface of the platform by the retaining structure, and the index member defines a window for viewing therethrough the indicia associated with the top surface of the platform. The index member is rotatable with respect to the top surface of the platform such that the window moves with respect to the indicia associated with the top surface of the platform. Both the platform and index member are configured to receive a straw generally in a center of the platform and index member. The index member includes stability-enhancing structure generally at a peripheral edge of the index member, and the stability-enhancing structure at least partially defines an edge of the window. The stability-enhancing structure is configured to prevent at least one edge of the index member which defines the window from engaging the retaining structure on the top surface of the platform, thereby allowing generally free rotation of the index member on the platform.

30 Claims, 9 Drawing Sheets

LID FOR A BEVERAGE CONTAINER

CROSS-REFERENCE

This application is a continuation-in-part of U.S. patent application Ser. No. 09/119,573, filed on Jul. 21, 1998.

FIELD OF THE INVENTION

The present invention relates generally to lids for covering beverage containers, such as drinking cups, and more specifically relates to a lid for covering a beverage container, where the lid includes a rotatable index member.

BACKGROUND OF THE INVENTION

Lids are often used to cover beverage containers. For example, plastic lids are often used to cover drinking cups so that any liquid contained in the drinking cup does not readily spill from the drinking cup. The lids also function to keep the drink which is contained in the drinking cup either cold or hot longer, whichever the case may be.

One example of a typical lid for a drinking cup is a light weight, clear plastic lid which secures to the top of the drinking cup. Because the lid is clear, the drink which is contained inside the cup is visible from outside the cup, through the lid. Typically, a hole is provided in the lid for receiving a straw and allowing access to the drink inside the cup without having to take the lid off the top of the drinking cup.

Another example of a typical lid for a drinking cup is a solid-colored, heavy duty plastic lid which secures to the top of the drinking cup. Because the lid is not clear, and is instead solid-colored, the drink which is contained inside the cup is not generally visible from outside the cup, through the lid. Again, a hole is typically provided in the lid for receiving a straw and allowing access to the drink inside the cup without having to take the lid off the top of the drinking cup.

Still another example of a typical lid for a drinking cup is a white, medium weight plastic lid which secures to the top of the drinking cup. A section of the lid is perforated or otherwise configured to provide that the section can be removed from the remainder of the lid, thereby providing an opening through which one can drink the beverage which is inside the drinking cup.

Each of the lids described above provides that the lid generally retains a beverage in a drinking cup while also providing access to the beverage without having to remove the lid from the top of the drinking cup. The lid also generally keeps the drink which is contained in the drinking cup either cold or hot longer, whichever the case may be. However, none of the lids described above provide an index member which can rotated to selectively view indicia.

OBJECTS AND SUMMARY

It is an object of the present invention to provide a lid for covering a beverage container, that includes a rotatable index member.

It is a further object of the present invention to provide such a lid for covering a beverage container that also includes a platform having a top surface with indicia associated therewith and wherein the index member defines a window to selectively view the indicia associated with the top surface of the platform upon rotation of the index member.

In accordance with these and other objects, the present invention provides a lid for covering a beverage container.

The lid includes a platform configured for engaging the container, and the platform includes retaining structure and a top surface with indicia associated therewith. An index member is retained generally on the top surface of the platform by the retaining structure, and the index member defines a window for viewing therethrough the indicia associated with the top surface of the platform. The index member is rotatable with respect to the top surface of the platform such that the window moves with respect to the indicia associated with the top surface of the platform. Desirably, both the platform and index member are configured to receive a straw generally in a center of the platform and index member, and the index member is generally circular.

The retaining structure may have any suitable construction that retains the index member on the top surface of the platform and that also permits rotation of the index member relative to the top surface of the platform. In a preferred embodiment, for example, the retaining structure includes a plurality of lips disposed about the circumference of the index member, or instead disposed about a perimeter of a central straw receiving portion of the index member. In accordance with alternative embodiments, the retaining structure may include an annular lip that extends about the circumference of the index member or instead that extends around a perimeter of a central straw receiving portion of the index member. In accordance with the a preferred embodiment, the top surface of the platform defines a generally circular well for receiving the index member, and the retaining structure also includes an annular wall defining the well.

The window of the index member may be a cut out which is generally pie-shaped. Desirably, the index member includes stability-enhancing structure generally at a peripheral edge of the index member, and the stability-enhancing structure at least partially defines an arcuate edge of the window and is configured to prevent at least one edge of the index member defining the window from engaging the retaining structure on the top surface of the platform, thereby allowing generally free rotation of the index member on the platform.

The indicia associated with the top surface of the platform may include a plurality of sets of facts where the window of the index member is configured for viewing therethrough the sets of facts. Desirably, the index member is rotatable with respect to the top surface of the platform, thereby providing that the sets of facts can be selectively viewed through the window.

Desirably, the index member also includes indicia thereon. Preferably, at least a portion of the indicia on the index member is adjacent the window and characterizes the indicia associated with the top surface of the platform. The indicia on the platform desirably corresponds in any suitable manner to the indicia on the index member. The indicia may relate to any suitable subject matter, such as newsworthy events, trivia, schedules, sports facts, movies, sporting events, etc. In accordance with one embodiment, for example, the indicia associated with the platform is in the form of sets of facts relating to an automobile racing event, and may include any desired information relating to the event, such as the names of past race car drivers who won the event, the names of past race car drivers who had the pole position in the race, the distance of the race, the location of the race, etc.

BRIEF DESCRIPTION OF THE DRAWINGS

The present invention and the advantages thereof will become more apparent upon consideration of the following detailed description when taken in conjunction with the accompanying drawings of which.

DETAILED DESCRIPTION OF EMBODIMENTS OF THE INVENTION

Figure 1:
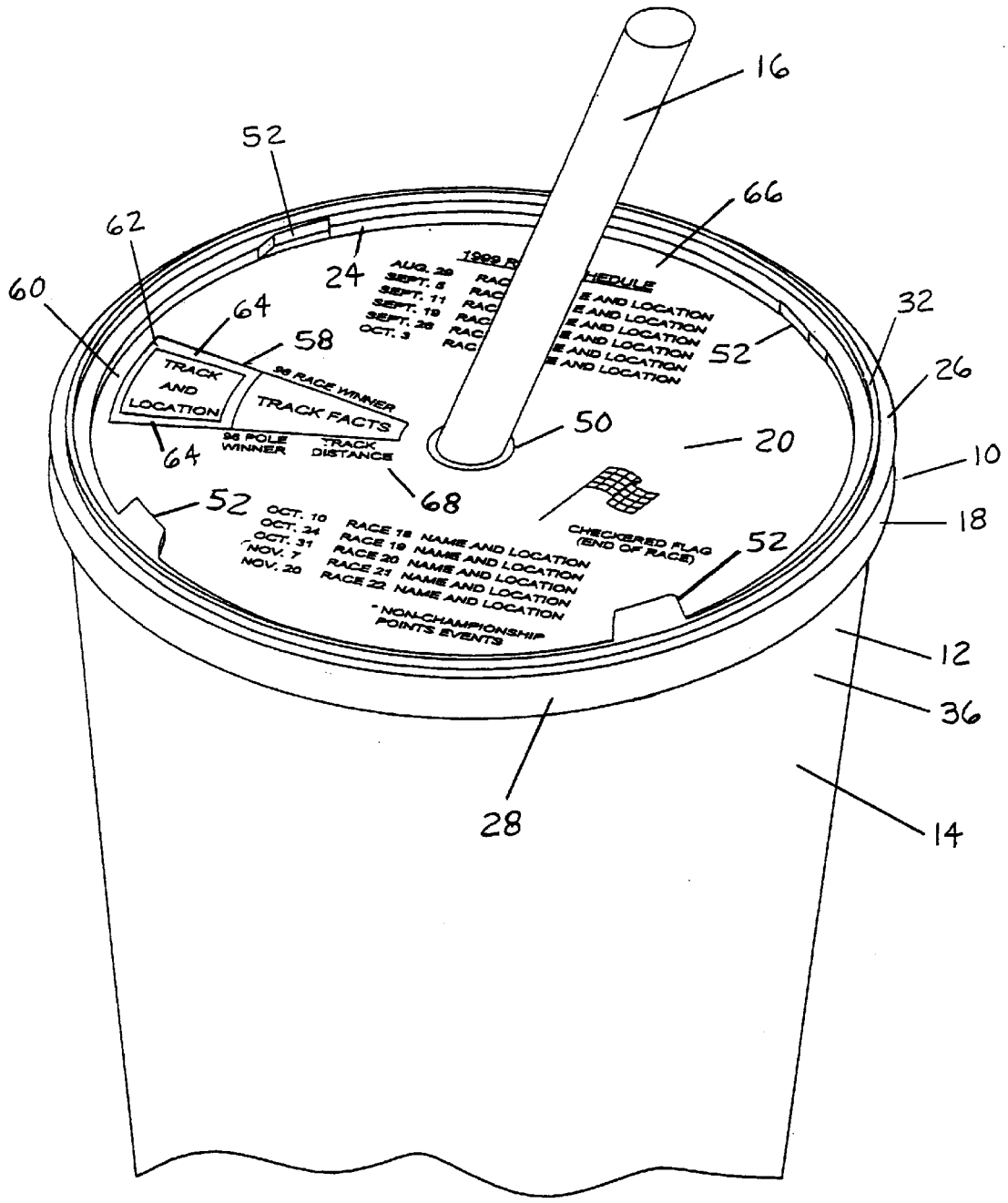
FIG. 1 is a perspective broken view of a lid in accordance with an embodiment of the present invention engaged with a top of a beverage container and with a straw, wherein the platform of the lid includes a plurality of lips disposed about the circumference of the index member of the lid for retaining the index member on the platform.

Illustrated in FIGS. 1, 2, 4, 5 and 6 is a lid 10 in accordance with an embodiment of the present invention. As illustrated in FIG. 1, the lid 10 is configured to engage the top 12 of a beverage container 14, such as a drinking cup. When the lid 10 is engaged with the top 12 of the beverage container 14, preferably the lid 10 generally retains, in the beverage container 14, any beverage contained in the beverage container 14, and generally tends to keep the beverage in the beverage container 14 either cold or hot, whichever the case may be. As illustrated in FIG. 1, preferably the lid 10 is configured to receive a straw 16 so that one can drink the beverage contained in the beverage container 14 through the straw 16, without having to remove the lid 10 from the top 12 of the beverage container 14. However, it is preferred that the lid 10 can be removed from the top 12 of the beverage container 14 so that after the beverage in the beverage container 14 is consumed, the lid 10 may be retained for reference or educational purposes.

Figure 2:
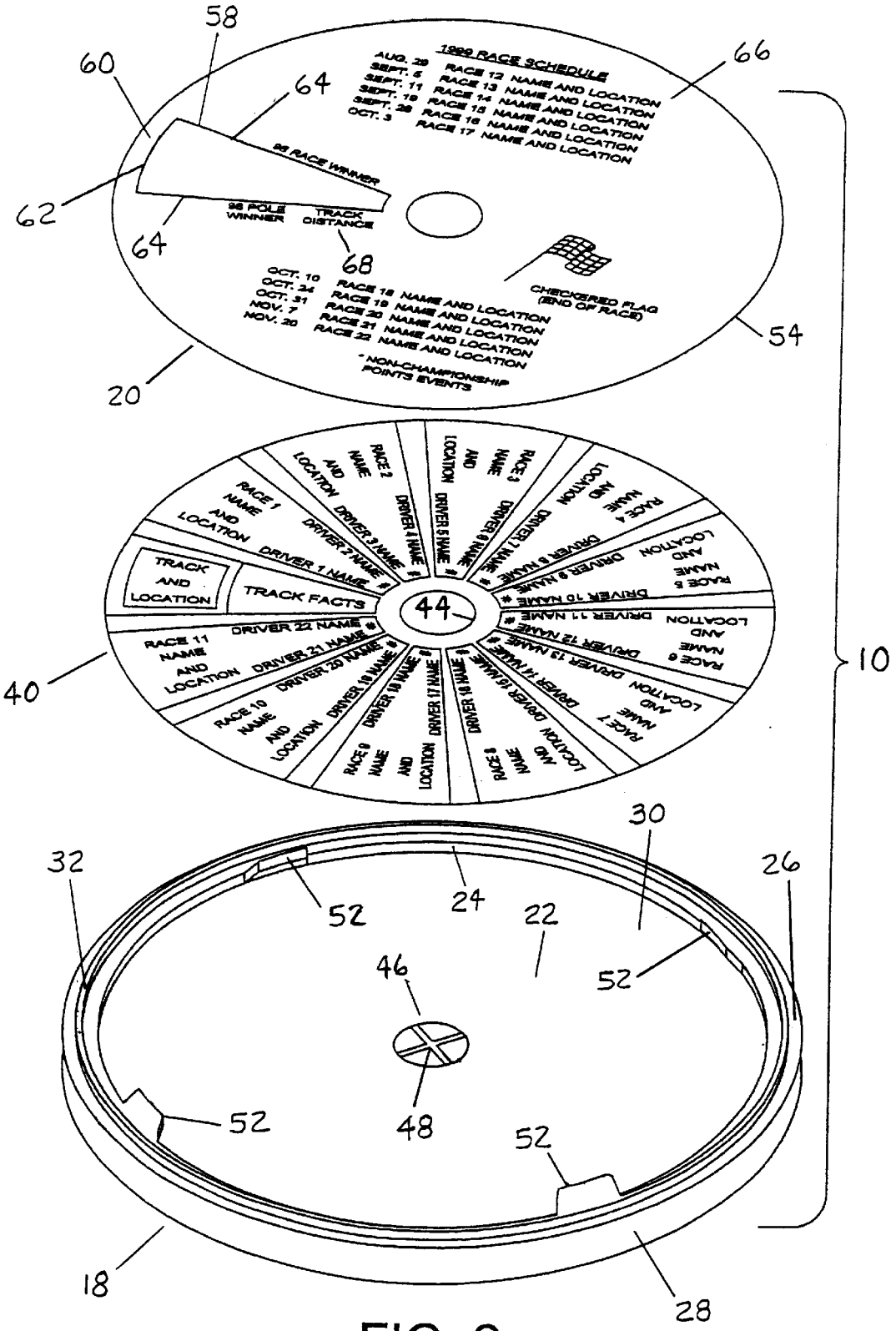
FIG. 2 is an exploded perspective view of the lid of FIG. 1.
Figure 4:
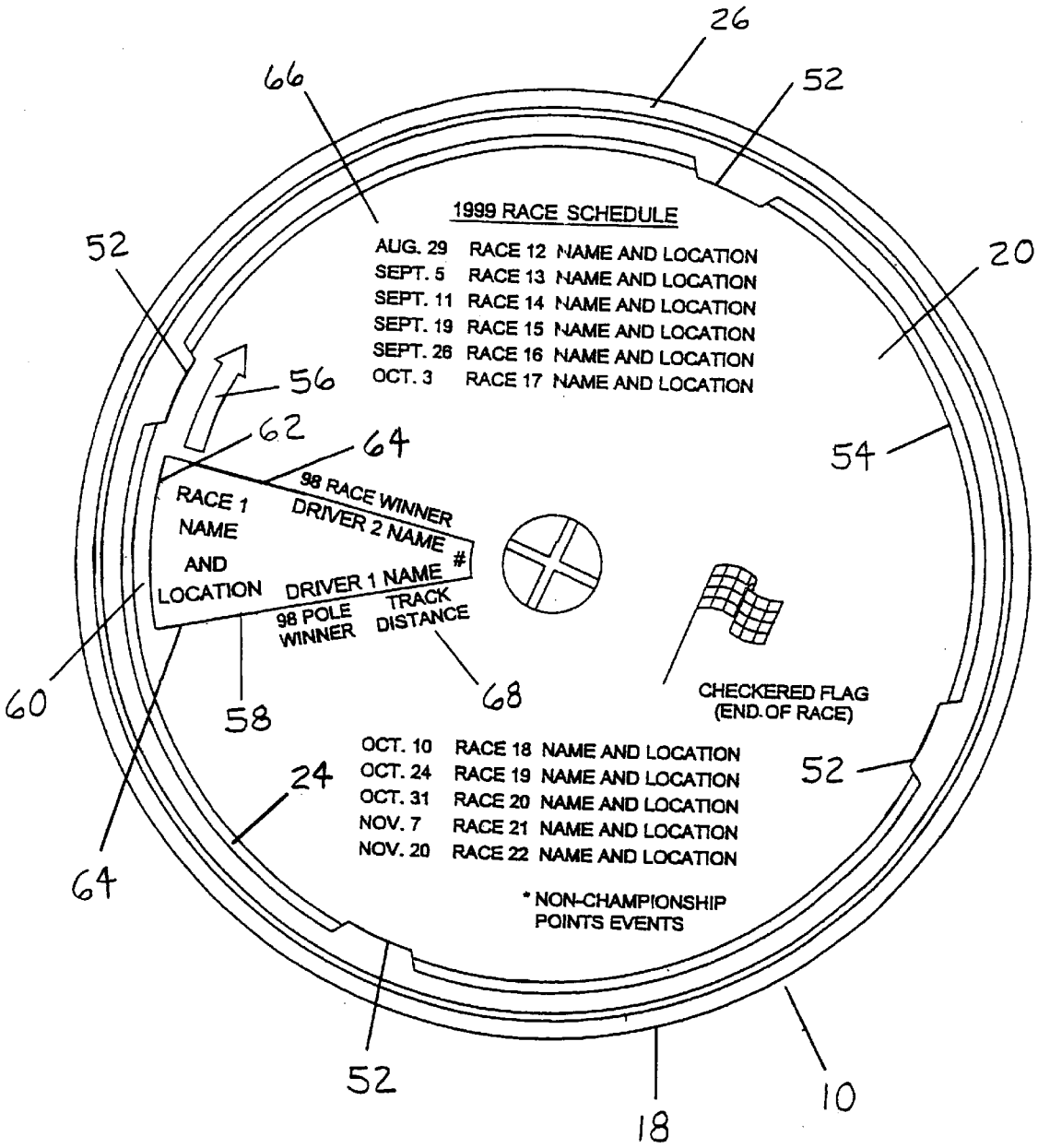
FIG. 4 is a top plan view of the lid of FIGS. 1 and 2, illustrating, using an arrow, the index member being rotated to cause a different set of facts to be displayed in a window defined by the index member.
Figure 5:
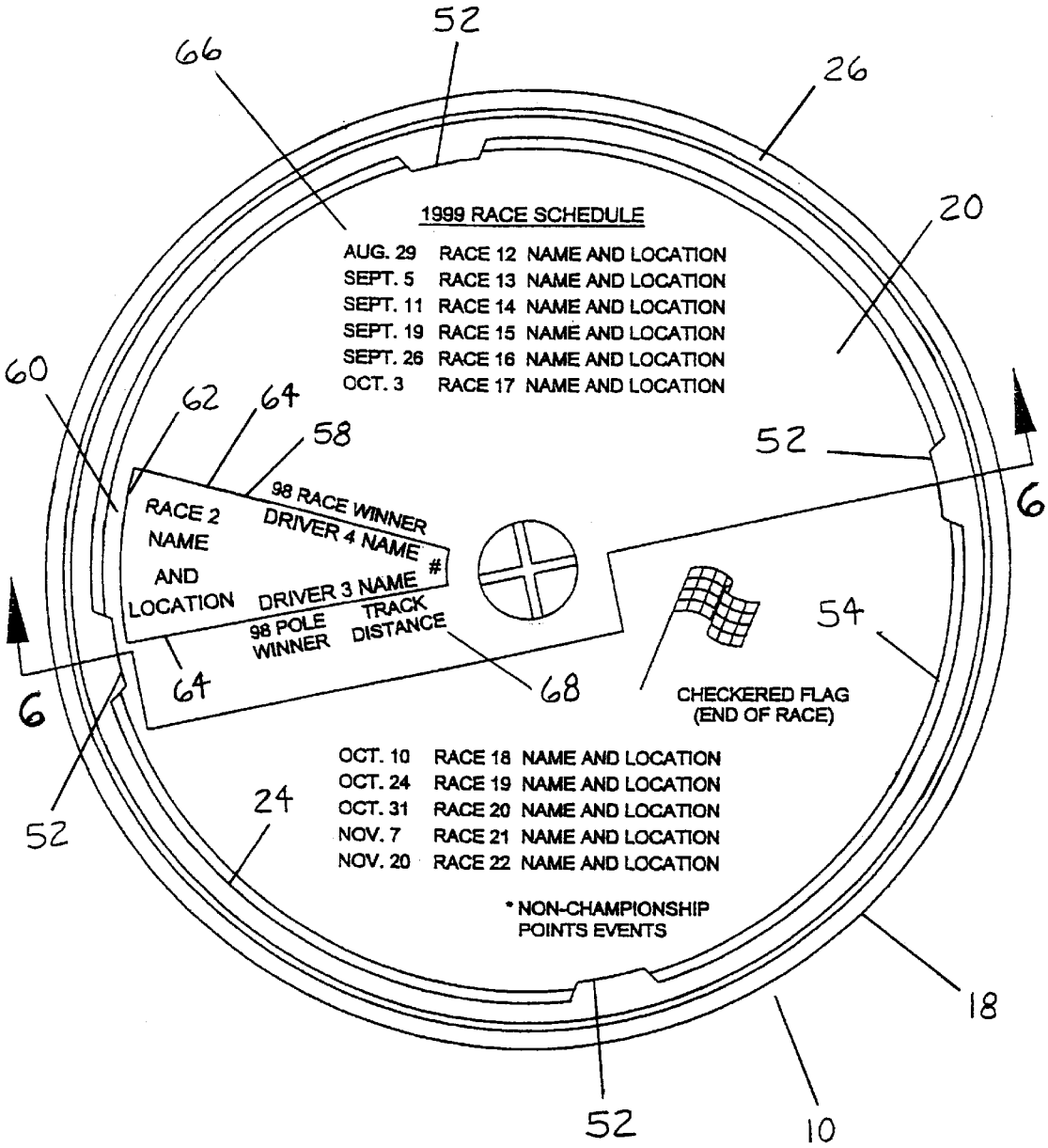
FIG. 5 is a top plan view, similar to FIG. 4, illustrating a different set of facts displayed in the window defined by the index member as a result of rotating the index member.
Figure 6:
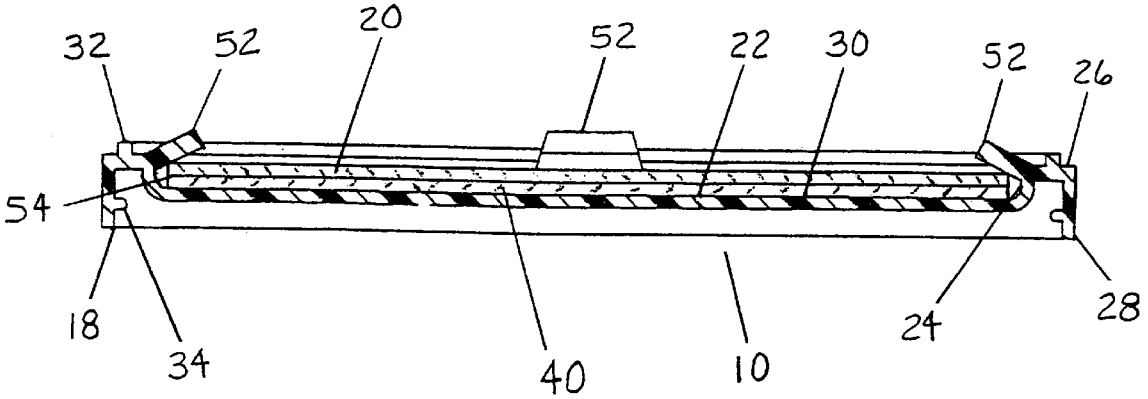
FIG. 6 is a cross-sectional view, taken along line 6—6 of FIG. 5.

As illustrated in FIGS. 1, 2, 4, 5 and 6, the lid 10 includes a platform 18 and an index member 20. As illustrated in FIGS. 2 and 6, the platform 18 preferably includes a generally flat top surface 22, an annular wall 24 surrounding the top surface 22, an annular rim 26 surrounding the annular wall 24, and a depending flange 28 surrounding the rim 26. The top surface 22 and the annular wall 24 define a generally circular well 30 receiving the index member 20. As illustrated in FIGS. 1–6, the platform 18 may also include a raised annular edge 32 extending from the rim 26 of the platform 18. Preferably, the platform 18 is formed of plastic, and is manufactured using a plastic injection molding or press molding process. The platform 18 may be any color, such as white. Preferably, the platform 18 is generally flexible and durable, and will not readily break or split.

As mentioned above, preferably the lid 10 is engageable with the top 12 of a beverage container 14. As illustrated in FIG. 6, for example, the depending flange 28 of the platform 18 preferably includes an inwardly-facing circumferential flange 34 for engaging a lip (not shown) on the external surface 36 of the top 12 of the beverage container 14 (see FIG. 1). However, other configurations are possible to provide that the platform 18 is engageable with the top 12 of a beverage container 14. For example, the depending flange 28 of the platform 18 may have a thread thereon for engaging a corresponding thread on the external surface 36 of the top 12 of the beverage container 14.

Figure 3:
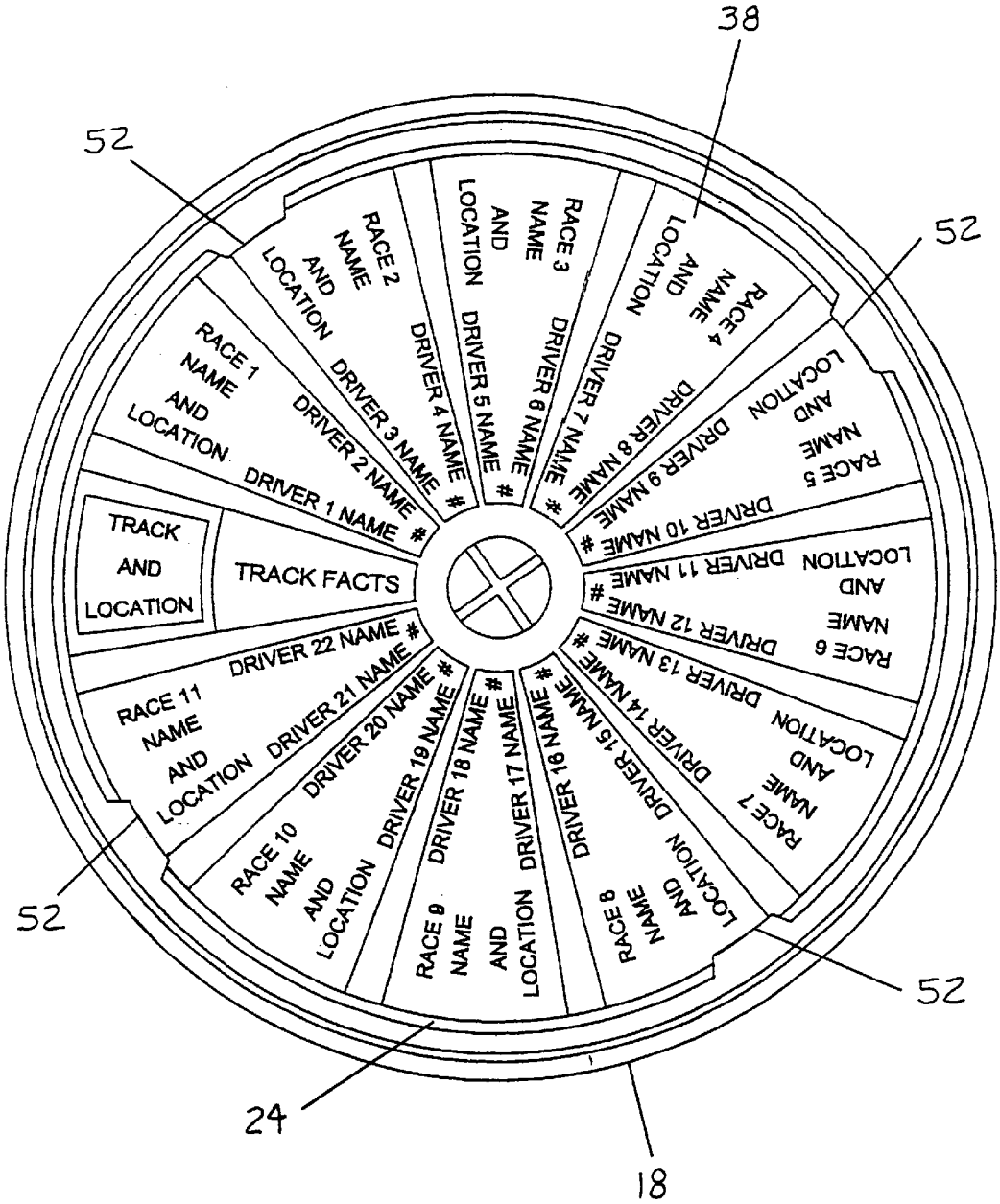
FIG. 3 is a top plan view of the lid of FIGS. 1 and 2, with the index member of the lid removed.

As illustrated in FIG. 3, the top surface 22 of the platform 18 preferably has indicia 38 associated therewith. The indicia 38 may be directly on the top surface 22 of the platform 18, or an indicia-carrying member 40, as illustrated in FIG. 2, may be stamped or adhered to or otherwise associated in any suitable manner with the top surface 22 of the platform 18. The indicia-carrying member 40, if provided, is preferably generally flat, and may be formed of paper or plastic, with the indicia 38 being disposed thereon. The indicia-carrying member 40 may be laminated.

As illustrated in FIG. 2, the index member 20 and the indicia-carrying member 40, if provided, have straw-receiving portions 42 and 44, respectively, which generally align with a straw-receiving portion 46 of the platform 18, which may be in the form of an opening or preferably a center cross mark 48, which allows penetration of the straw 16 when the straw is inserted therethrough, as illustrated in FIG. 1. The straw-receiving portions 42, 44 and 46 may take on any other suitable configurations, such as a circle which is perforated along a substantial portion of its circumference (not shown). In this regard, it is preferred that the straw-receiving portions 42, 44 and 46 provide for receipt of the straw 16 without having to provide a true opening which may be in violation of one or more health codes. In any event, upon receipt of the straw 16, the straw-receiving portions 42, 44 and 46 together generally provide a through opening 50, as illustrated in FIG. 1, for receiving a straw 16 into the beverage container 14 so that one can drink the beverage contained in the beverage container 14 through the straw 16 without having to remove the lid 10.

The platform includes retaining structure for retaining the index member on the top surface 22 of the platform 18. In the embodiment of FIGS. 1–6, for example, the platform 18 includes a plurality of lips 52, and the lips 52 and desirably the annular wall 24 retain the index member 20 generally on the top surface 22 of the platform 18, desirably within the well 30. Preferably, the lips 52 extend from, or at least are in the general proximity of, the annular wall 24 of the platform 18. The lips 52 retain a peripheral edge 54 of the index member 20 under the lips 52, thereby together with the annular wall 24 retaining the index member 20 generally on the top surface 22 of the platform 18 and generally in the well 30.

The index member 20 is preferably retained on the top surface 22 of the platform 18 in such a manner that the index member 20 is rotatable with respect to the top surface 22 of the platform 18. Rotation of the index member 20, as represented by the arrow 56 appearing in FIG. 4, causes the index member 20 to change position or move relative to the top surface 22 of the platform 18. An example of a resulting change in relative position between the index member 20 and the platform 18 is illustrated in the progression from FIG. 4 to FIG. 5.

As illustrated in FIGS. 1, 2, 4 and 5, the index member 20 is preferably generally flat and defines a window 58 through which the indicia 38 associated with the top surface 22 of the platform 18 can be viewed. As illustrated in the progression from FIG. 4 to FIG. 5, the rotatability of the index member 20 relative to the top surface 22 of the platform 18 provides that, when the index member 20 is rotated relative to the top surface 22 of the platform 18, the window 58 changes position or moves relative to the indicia 38 associated with the top surface 22 of the platform 18.

Preferably, the index member 20 includes stability-enhancing structure 60 generally at the peripheral edge 54 of the index member 20, and the stability-enhancing structure 60 defines an arcuate edge 62 of the window 58. Desirably, the stability-enhancing structure 60 is configured to prevent adjacent edges 64 of the index member 20 which define the window 58 from engaging the retaining structure 52 on the platform 18 when the index member 20 is rotated relative to the platform 18. Therefore, the index member 20 can freely rotate on the top surface 22 of the platform 18.

The window 58 defined by the index member 20 may be a cut out which is shaped generally like a piece of pie (i.e. a generally pie-shaped cut out). However, the window 58 may take other shapes. Additionally, while FIGS. 1, 2, 4 and 5 depict the index member 20 as defining a single window 58, the index member 20 may instead define a plurality of windows for viewing indicia 38 therethrough. If the index member 20 defines a plurality of windows, additional stability-enhancing structure may be provided to ensure that the edges of the index member 20 which define the windows do not engage the retaining structure 52 upon rotation of the index member 20 on the platform 18.

The index member 20 may be formed of a circular piece of paper or plastic, and, as illustrated in FIGS. 1, 2, 4 and 5, may have indicia 66 thereon. The index member 20 may be laminated or plastic. At least a portion 68 of the indicia 66 on the index member 20 may be located generally adjacent the window 58 and may characterize at least a portion of the indicia 38 associated with the top surface 22 of the platform 18. One specific example of possible indicia which may be provided as being associated with the top surface 22 of the platform 18 and the index member 20 will now be described.

As illustrated in FIG. 3, the indicia 38 on the top surface 22 of the platform 18 may be a plurality of sets of facts. The facts may relate to news, movies or sports events or trivia, such as, for example, statistics relating to such sports as car racing, golf, football, basketball, etc. Hence, when the index member 20 is rotated as illustrated by the progression from FIG. 4 to FIG. 5, and by arrow 56 in FIG. 4, the rotation causes a different set of facts to be displayed in the window 58 defined by the index member 20. In other words, the index member 20 may be rotated to selectively view, through the window 58, the different sets of facts associated with the top surface 22 of the platform 18.

In FIGS. 1–9, the indicia 38 associated with the top surface 22 of the platform 18 and the index member 20 relates to car racing. Although not illustrated, the external surface 36 of the beverage container 14 may also have indicia thereon relating to car racing. As illustrated in FIG. 3, the indicia 38 on the top surface 22 of the platform 18 includes different sets of facts or information where each set corresponds to a different car racing event which has taken place in the past. Specifically, each set includes the name and location of the race, the name of the race car driver who won the race, the name of the race car driver who had the pole position in the race, and the distance of the track on which the racing event took place (all of this is indicated generically in the FIGURES). Therefore, by rotating the index member 20 relative to the platform 18, as illustrated in the progression from FIG. 4 to FIG. 5, and by arrow 58 in FIG. 4, facts relating to different past racing events can be selectively viewed through the window 58.

As illustrated in FIGS. 4 and 5, the indicia 66 on the index member 20 may include a racing schedule as well as other indicia such as a checkered flag and a logo (not shown). As mentioned hereinabove, other indicia 68 on the index member 20 may characterize the indicia which is associated with the top surface 22 of the platform 18. As illustrated, this characterizing indicia 68 may be located generally adjacent the window 58, and may indicate where in the window 58 the name of the race car driver who won the race is displayed, where in the window 58 the name of the race car driver who had the pole position in the race is displayed, and where in the window 58 the distance of the track on which the racing event took place is displayed.

The indicia 38 and 66 provided associated with the top surface 22 of the platform 18 and on the index member 20, respectively, may take other forms than is depicted in FIGS. 1–5 and 7–9. For example, the indicia may still relate to car racing, but the each set of facts on the top surface 22 of the platform 18 may relate to a different driver rather than a different race, and the indicia 66 on the index member 20 may relate to the specifications of a race car. There are countless other possibilities.

While the indicia 38 and 66 provided on the top surface 22 of the platform 18 and the index member 20, respectively, may not relate to car racing and may not even relate to sports at all, it is preferred that the indicia which is thereon provides that the lid generally provides an educational, informative and/or entertaining product. Therefore, after the beverage in the beverage container 14 is consumed, the lid 10 may be removed and retained for future reference and/or entertainment.

Figure 7:
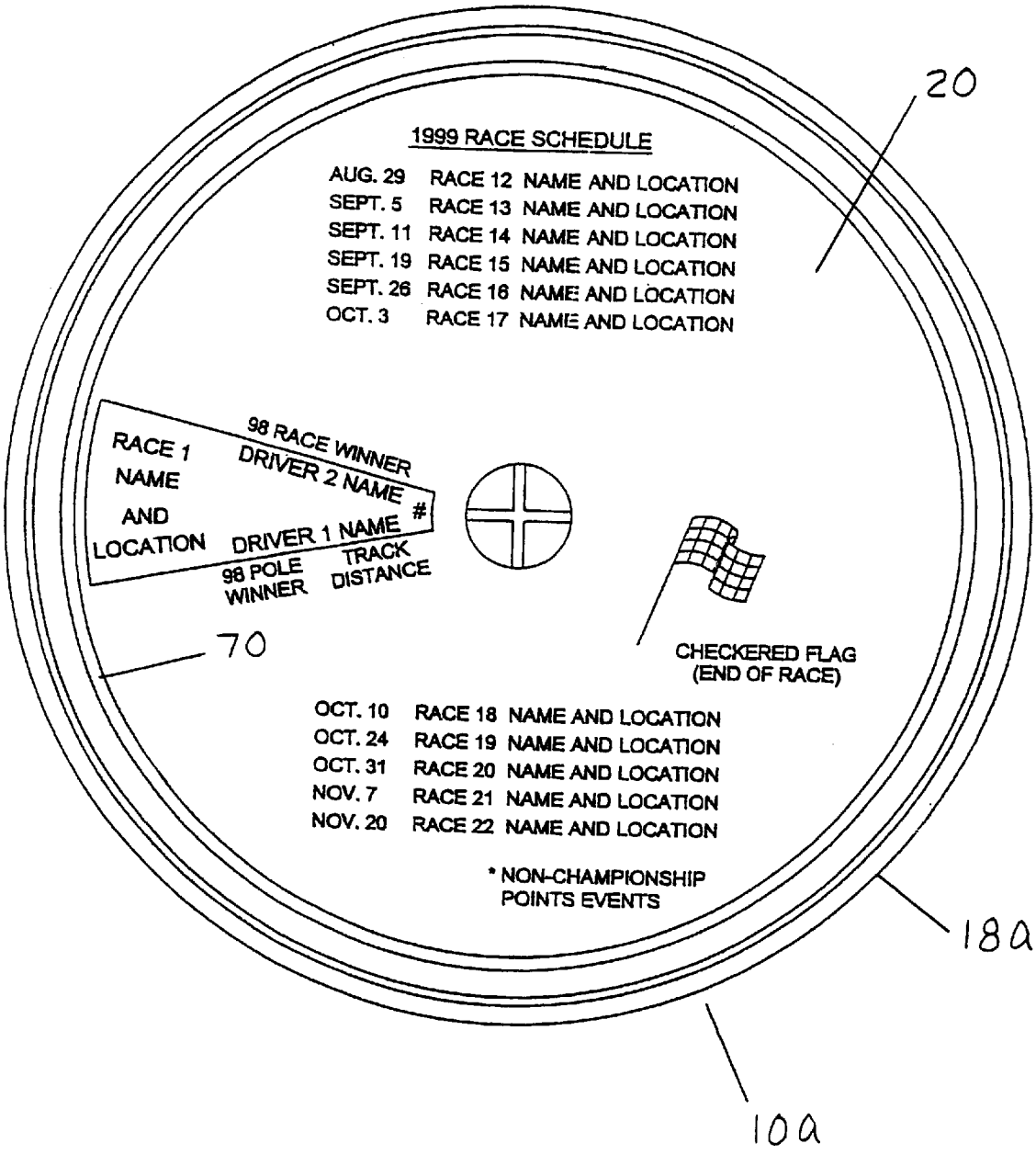
FIG. 7 is a top plan view, similar to FIGS. 4 and 5, illustrating a lid in accordance with another embodiment of the present invention, wherein the platform includes an annular lip disposed about the circumference of the index member for retaining the index member on the platform.
Figure 8:
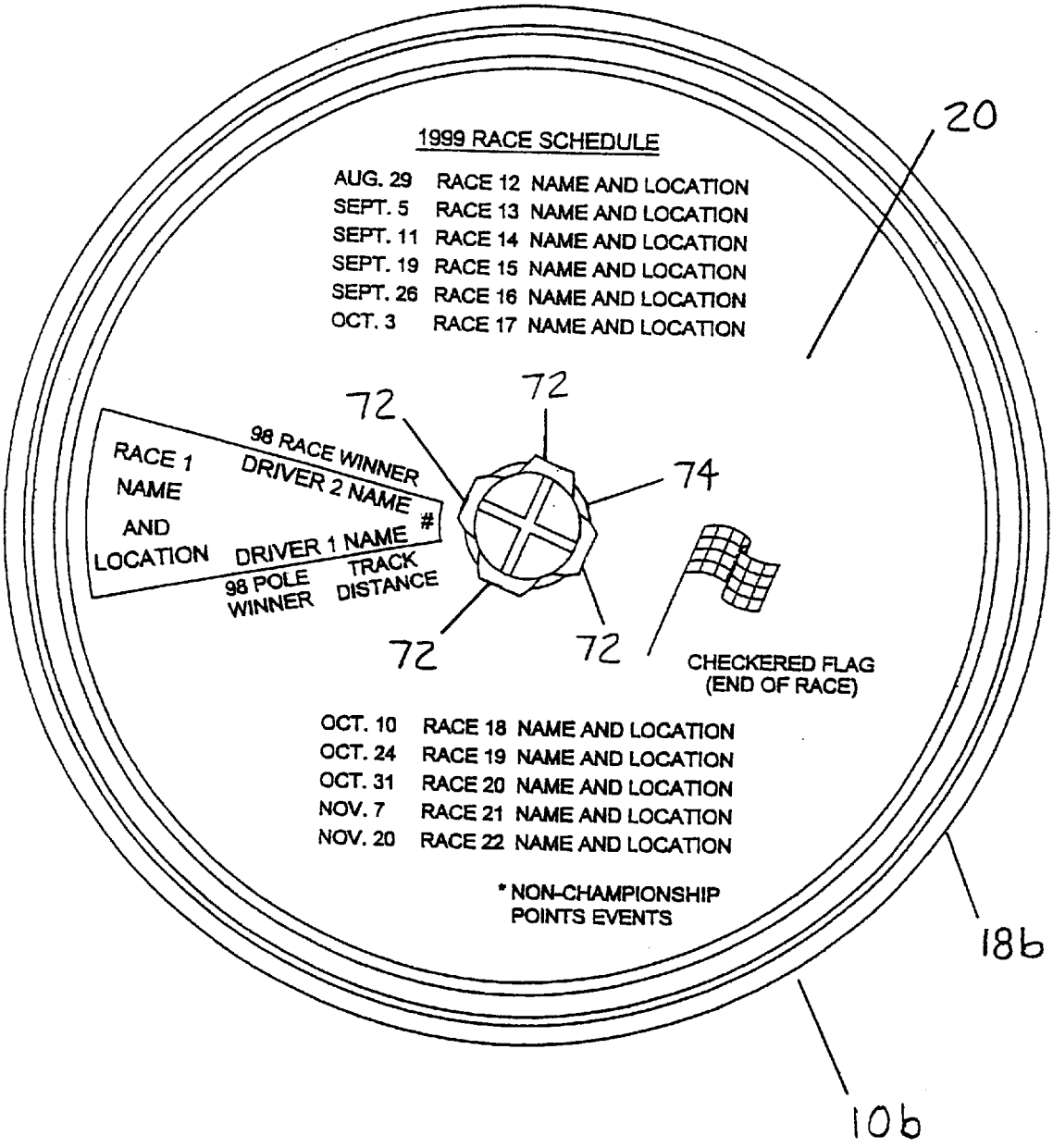
FIG. 8 is a top plan view, similar to FIGS. 4, 5, 7 and 8, illustrating a lid in accordance with still yet another embodiment of the present invention, wherein the platform includes a plurality of lips disposed about the perimeter of the straw-receiving portion of the index member on the platform.
Figure 9:
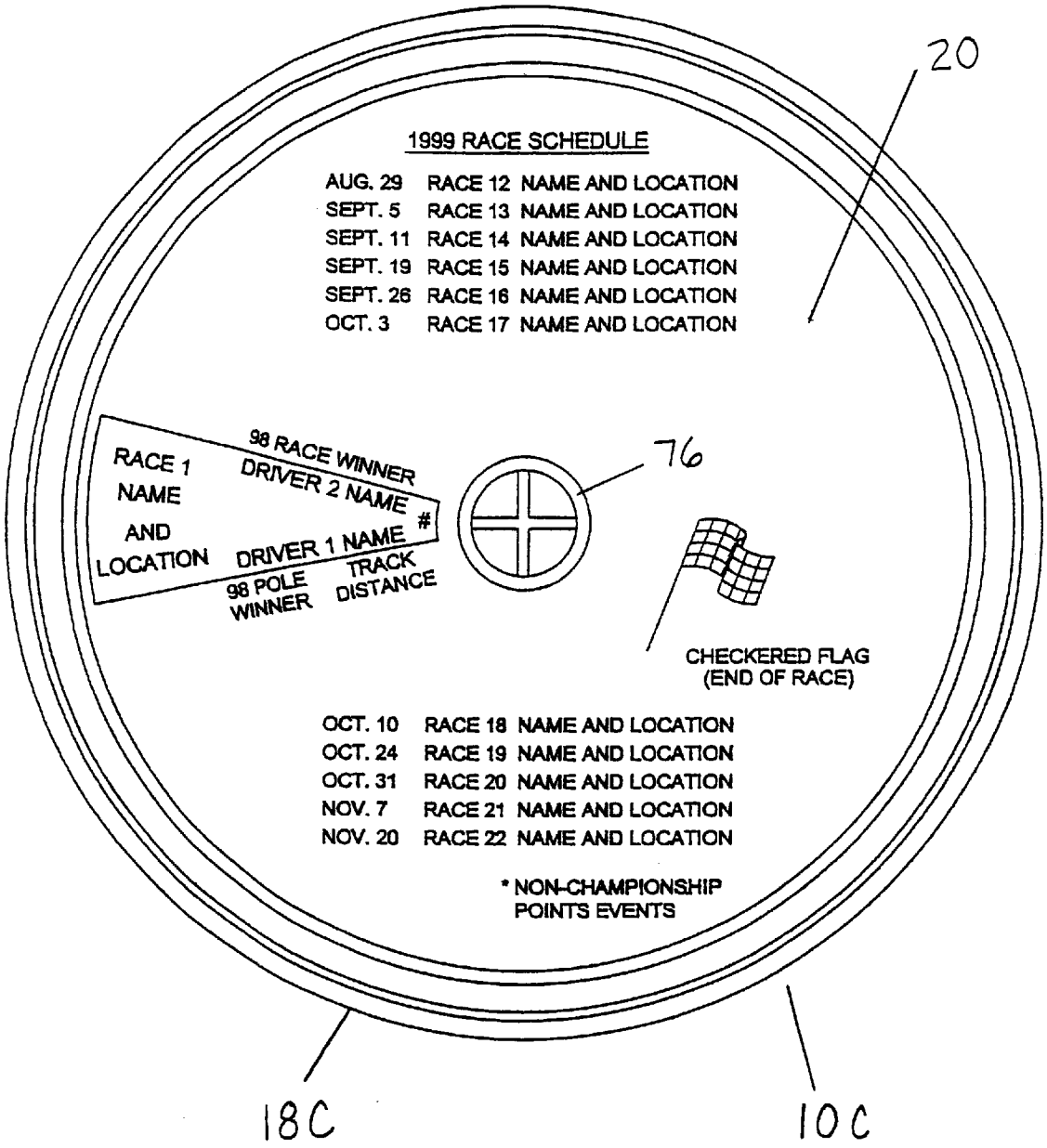
FIG. 9 is a top plan view, similar to FIGS. 4, 5, 7 and 8, illustrating a lid in accordance with still another embodiment of the present invention, wherein the platform includes an annular lip disposed about the perimeter of a straw-receiving portion of the index member for retaining the index member on the platform.

Illustrated in FIGS. 7–9 are three other lids 10*a*, 10*b* and 10*c* in accordance with other embodiments of the present invention. The lids 10*a*, 10*b* and 10*c* are generally identical to the lid 10 illustrated in FIGS. 1–6, but provide alternative and/or additional retaining structure respectively, for retaining the index member 20 generally on the top surface of the platform 18*a*, 18*b*, 18*c*.

Specifically, FIG. 7 depicts a lid 10*a* which includes a platform 18*a* which provides an annular lip 70 which, desirably together with the annular wall 24 (see FIG. 6) of the platform 18*a*, retain the peripheral edge of the index member 20. Like the lips 52 of the lid 10 illustrated in FIGS. 1–6, the annular lip 70 of the lid 10*a* illustrated in FIG. 7 provides that the index member 20 can rotate generally on the top surface of the platform 18*a*.

FIG. 8 illustrates a lid 10*b* which includes a platform 18*b* which provides an inner set of lips 72 which retain the index member 20 generally on the top surface of the platform 18*b*. Specifically, the inner set of lips 72 retain an inside edge 74 of the index member 20, where the inside edge 74 of the index member 20 defines the central opening 42 (see FIG. 2)

for receiving a straw 16. Like the circumferentially-spaced lips 52 of the lid 10 illustrated in FIGS. 1–6, the inner set of lips 72 of the lid 10*b* illustrated in FIG. 8 provides that the index member 20 can rotate generally on the top surface of the platform 18*b*.

In accordance with a further embodiment, the inner set of lips 72 of the lid 10*b* illustrated in FIG. 8 may be employed along with the outer set of lips 52 of the lid 10 illustrated in FIGS. 1–6. In this case, the inner set of lips 72 retain the inside edge 74 of the index member 20, and the outer lips 52, along with the annular wall 24 (see FIG. 6), retain the peripheral edge 54 of the index member 20. Again, desirably the index member 20 is retained in a manner such that it is rotatable generally on the top surface of the platform.

FIG. 9 illustrates a lid 10*c* which includes a platform 18*c* which provides an annular lip 76 which retains the index member 20 generally on the top surface of the platform 18*c*. Specifically, the annular lip 76 of the platform 18*c* retains an inside edge of the index member 20, where the inside edge of the index member 20 defines the central opening 42 (see FIG. 2) for receiving a straw 16. Like the lips 52 of the lid 10 illustrated in FIGS. 1–6, the annular lip 76 of the lid 10*c* illustrated in FIG. 9 provides that the index member 20 can rotate generally on the top surface of the platform 18*c*.

In accordance with a further embodiment, the inner annular lip 76 may be employed along with an outer annular lip 70 as illustrated in FIG. 7 to retain the index member 20 generally on the top surface of the platform 18*a*.

Still other configurations of retaining structure are possible. For example, an outer annular lip and an inner set of circumferentially-spaced lips may be employed, or an inner annular lip and an outer set of circumferentially-spaced lips may be employed. Additionally, other structures beside an annular lip and circumferentially-spaced lips may be utilized to retain the index member 20 generally on the top surface of the platform in a manner such that the index member is generally rotatable.

While embodiments of the present invention are shown and described, it is envisioned that those skilled in the art may devise various modifications of the present invention without departing from the spirit and scope of the appended claims.

The claimed invention is:

1. A lid for covering a beverage container, the lid comprising:

a platform configured for engaging the container, wherein the platform includes retaining structure and a top surface with indicia associated therewith; and an index member retained generally on the top surface of the platform by the retaining structure, the index member defining a window for viewing therethrough the indicia associated with the top surface of the platform, wherein the index member is rotatable with respect to the top surface of the platform such that the window moves with respect to the indicia associated with the top surface of the platform the platform and the index member is configured to receive a straw generally in a center of the platform and the index member.

2. The lid of claim 1 wherein the index member is generally circular and the retaining structure comprises a lip.

3. The lid of claim 2 wherein the retaining structure comprises a plurality of lips.

4. The lid of claim 3 wherein the lips are disposed about the circumference of the index member.

5. The lid of claim 4 wherein there are four lips generally equally spaced about the circumference of the index member.

6. The lid of claim 3 wherein the index member defines a straw receiving portion, the lips being disposed about a perimeter of the straw receiving portion.

7. The lid of claim 2 wherein the lip is annular and is disposed about the circumference of the index member.

8. The lid of claim 2 wherein the index member defines a generally circular straw receiving portion, and wherein the lid is annular and is disposed about a perimeter of the straw receiving portion.

9. The lid of claim 2 wherein the top surface of the platform defines a generally circular well receiving the index member.

10. The lid of claim 9 wherein the retaining structure further includes an annular wall of the platform defining the well and surrounding the top surface, the lip adjacent the annular wall.

11. The lid of claim 10 wherein the platform includes a rim surrounding the annular wall, the lip extending from the rim.

12. The lid of claim 1 wherein the index member includes stability-enhancing structure generally at a peripheral edge of the index member, and wherein the stability-enhancing structure defines the window.

13. The lid of claim 12 wherein the stability-enhancing structure defines an arcuate edge of the window and is configured to prevent the index member from engaging the lip during rotation of the index member on the platform.

14. The lid of claim 1 wherein the window of the index member is generally pie-shaped.

15. The lid of claim 1 wherein the indicia associated with the top surface of the platform comprises a plurality of sets of facts, and wherein the window of the index member is configured for viewing therethrough the sets of facts associated with the top surface of the platform, thereby providing that the plurality of the sets of facts can be selectively viewed through the window upon rotation of the index member with respect to the top surface of the platform.

16. The lid of claim 15 wherein the index member includes indicia thereon.

17. The lid of claim 16 wherein at least a portion of the indicia on the index member is adjacent the window and characterizes the indicia associated with the top surface of the platform.

18. The lid of claim 16 wherein each of the sets of facts associated with the top surface of the platform corresponds to a past racing event.

19. The lid of claim 18 wherein each of the sets of facts includes a name of a race car driver who won the past racing event.

20. The lid of claim 19 wherein each of the sets of facts includes a name of a race car driver who had pole position in the past racing event.

21. The lid of claim 19 wherein each of the sets of facts includes a distance of a track on which the past racing event took place.

22. The lid of claim 15 wherein the index member includes indicia thereon, the indicia including a racing schedule.

23. The lid of claim 22 wherein the sets of facts associated with the top surface of the platform relate to racing.

24. A lid for covering a beverage container and receiving a straw therethrough and into the beverage container, the lid comprising:

a platform configured for engaging the container, wherein the platform includes a straw receiving portion for receiving the straw into the container, wherein the platform includes retaining structure and a top surface having a plurality of sets of facts associated therewith; and an index member retained generally on the top surface of the platform by the retaining structure, wherein the index member includes a straw receiving portion for receiving the straw into the container, wherein the index member defines a window for viewing therethrough the sets of facts associated with the top surface of the platform, wherein the index member is rotatable with respect to the top surface of the platform such that the window moves with respect to the sets of facts associated with the top surface of the platform, thereby providing that the sets of facts can be selectively viewed through the window, wherein the index member has indicia displayed thereon, wherein at least some of the indicia on the index member is adjacent the window of the index member and characterizes the facts which are associated with the top surface of the platform.

25. The lid of claim 24 wherein the index member is generally circular and the retaining structure includes a lip of the platform and an annular wall of the platform surrounding the top surface and defining a generally circular well, the well receiving the index member.

26. The lid of claim 25 wherein the retaining structure comprises a plurality of lips extending adjacent the well and disposed about the circumference of the index member.

27. The lid of claim 26 wherein there are four lips generally equally spaced about the circumference of the index member.

28. The lid of claim 25 wherein the platform includes a rim surrounding the annular wall, the lip extending from the rim.

29. The lid of claim 24 wherein the indicia on the index member characterize the sets of facts associated with the top surface of the platform.

30. The lid of claim 29 wherein the sets of facts and the indicia relate to racing.

* * * * *